US007542689B2

(12) United States Patent
Ida et al.

(10) Patent No.: US 7,542,689 B2
(45) Date of Patent: Jun. 2, 2009

(54) CHARGING DEVICE, IMAGE FORMING APPARATUS, COMPUTER READABLE MEDIUM STORING CHARGING CONTROL PROGRAM AND METHOD FOR CHARGING CONTROL

(75) Inventors: Akihiro Ida, Ebina (JP); Yoshihisa Kitano, Ebina (JP); Takuro Hagiwara, Ebina (JP); Hideki Moriya, Ebina (JP); Chikaho Ikeda, Ebina (JP); Hidehiko Yamaguchi, Ebina (JP); Masao Ohmori, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 181 days.

(21) Appl. No.: 11/802,355

(22) Filed: May 22, 2007

(65) Prior Publication Data

US 2008/0101809 A1 May 1, 2008

(30) Foreign Application Priority Data

Oct. 27, 2006 (JP) ..... 2006-292406

(51) Int. Cl.
*G03G 15/02* (2006.01)

(52) U.S. Cl. ..... 399/50; 399/44; 399/89

(58) Field of Classification Search ..... 399/44, 399/50, 66, 89, 168
See application file for complete search history.

(56) References Cited

U.S. PATENT DOCUMENTS

| | | | | |
|---|---|---|---|---|
| 6,532,347 | B2 * | 3/2003 | Watanabe et al. | 399/50 |
| 7,024,125 | B2 * | 4/2006 | Ishii et al. | 399/50 |
| 2001/0055496 | A1 * | 12/2001 | Shimura et al. | 399/50 |
| 2005/0002681 | A1 * | 1/2005 | Takahashi et al. | 399/50 |

FOREIGN PATENT DOCUMENTS

| | | |
|---|---|---|
| JP | 2001-201919 | 7/2001 |
| JP | 2004-333789 | 11/2004 |

* cited by examiner

*Primary Examiner*—Timothy J Thompson
*Assistant Examiner*—Gregory H Curran
(74) *Attorney, Agent, or Firm*—Morgan, Lewis & Bockius LLP

(57) ABSTRACT

A charging device includes a charging member that charges a body to be charged; a detector that detects an AC component of a current flowing through the charging member; an integration section that integrates the AC component of the current detected by the detector; a controller that controls the current flowing through the charging member, according to a result of integration executed by the integration section; a periodic signal generating section that generates a periodic signal having a cycle period corresponding to a cycle period of the AC component; and an integration period adjusting section that adjusts a period of integration executed by the integration section, with reference to the periodic signal.

19 Claims, 14 Drawing Sheets

CHANGE IN ELECTRICITY IN RELATION TO CHANGE IN Iac

DIFFERENTIAL CHARGE
$\Delta Q = |Qa| - |Qb|$

| ENVIRONMENT | TEMPERATURE/HUMIDITY INSIDE APPARATUS | CCP VALUE |
|---|---|---|
| C | 11℃/19% | 151 |
| B | 25℃/53% | 141 |
| A | 34℃/71% | 143 |

S20

CHARGING DEVICE, IMAGE FORMING APPARATUS, COMPUTER READABLE MEDIUM STORING CHARGING CONTROL PROGRAM AND METHOD FOR CHARGING CONTROL

CROSS-REFERENCE TO RELATED APPLICATIONS

This application is based on and claims priority under 35 USC 119 from Japanese Patent Application No. 2006-292406 filed Oct. 27, 2006.

BACKGROUND

Technical Field

The present invention relates to a charging device, an image forming apparatus, a computer readable medium storing a charging control program and a method for charging control.

SUMMARY

According to an aspect of the invention, there is provided a charging device including a charging member that charges a body to be charged; a detector that detects an AC component of a current flowing through the charging member; an integration section that integrates the AC component of the current detected by the detector; a controller that controls the current flowing through the charging member, according to a result of integration executed by the integration section; a periodic signal generating section that generates a periodic signal having a cycle period corresponding to a cycle period of the AC component; and an integration period adjusting section that adjusts a period of integration executed by the integration section, with reference to the periodic signal.

BRIEF DESCRIPTION OF THE DRAWINGS

Exemplary embodiments of the present invention will be described in detail based on the following figures, wherein:

FIGS. 5A and 5B are graphic representations of surface potential of the image carrier and of the quantity of electricity discharged from the charging member to the image carrier when a peak-to-peak voltage Vpp (V) of AC voltage is changed to change the amount of AC current Iac, wherein FIG. 5A is a graph showing change in the surface potential of the image carrier in relation to change in the peak-to-peak voltage Vpp and FIG. 5B is a graph showing change in the quantity of electricity discharged in relation to change in the peak-to-peak voltage Vpp;

FIGS. 6A and 6B are graphic representations of quantities of electricity discharged from the charging member to the image carrier when the amount of AC current Iac is changed, wherein FIG. 6A is a graph showing change in quantities of both positive and negative electricity discharged in relation to change in the AC current Iac and FIG. 6B is a graph showing change in differential charge in relation to change in the AC current Iac;

FIGS. 7A, 7B, and 7C are graphic representations of phases of charge quantities when the amount of AC current Iac is changed, wherein FIG. 7A is a graph showing a phase in a domain where no discharge occurs in the initial environment, FIG. 7B is a graph showing a phase in a domain where no discharge occurs, as the environment changes, and FIG. 7C is a graph showing a phase in a domain where discharge occurs;

FIGS. 9A and 9B illustrate relationship between delay time values of charge quantity with reference to a periodic signal and environmental conditions, wherein FIG. 9A is a graph showing change in delay time in relation to temperature inside the image forming apparatus and FIG. 9B is a table associating environment details shown in FIG. 9A with delay time values;

DETAILED DESCRIPTION

Then, exemplary embodiments of the present invention are described based on the drawings.

Figure 1:
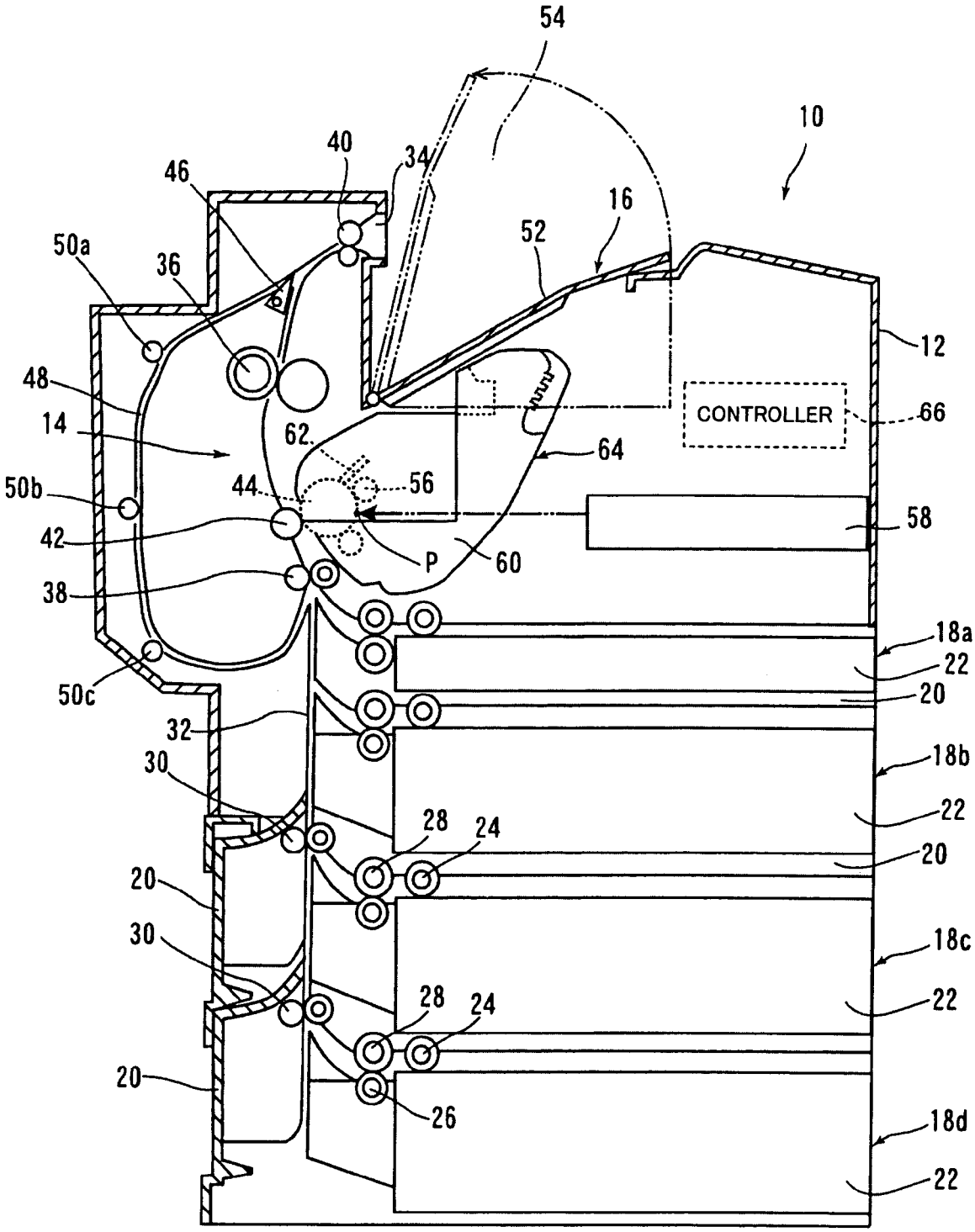
FIG. 1 is a side view showing an outline of an image forming apparatus relevant to an exemplary embodiment of the present invention.

FIG. 1 shows an outline of an image forming apparatus 10 relevant to an exemplary embodiment of the present invention. The image forming apparatus 10 has an image forming apparatus main body 12. An image forming section 14 is installed inside the image forming apparatus main body 12 and an output tray 16, which will be described later, is provided on the top of the image forming apparatus main body 12. In the lower part of the image forming apparatus main body 12, for example, two stages of paper feeder units 18*a*, 18*b* are disposed. Moreover, two stages of paper feeder units 18*c*, 18*d* which may be mounted or removed optionally are disposed in the lowest part of the image forming apparatus main body 12.

Each of the paper feeder units 18*a* to 18*d* has a paper feeder main body 20 and a paper cassette 22 in which paper sheets are placed. The paper cassette 22 is installed slidably against the paper feeder main body 20 and pulled out toward the front (toward the right in FIG. 1). On the top of the paper cassette 22 and near its back end, a paper feed roller 24 is placed. Ahead of the paper feed roller 24, a retard roller 26 for separating one paper sheet from another and a feed roller 28 for moving a paper sheet onto a paper passage are placed.

Further, a pair of transport rollers 30 are provided for each of the optional paper feeder units 18*c*, 18*d*.

A transport path 32 is a paper passage from the transport rollers 30 of the lowest paper feeder unit 18*d* up to an outlet 34. This transport path 32 is provided nearer to the rear surface (the left-side surface in FIG. 1) of the image forming apparatus main body 12 and has a part that is formed more or less vertically from the transport rollers 30 of the lowest paper feeder unit 18*d* to a fixing device 36 which will be described later. Upstream of the fixing device 36 on the transport path 32, a transfer device 42 and an image carrier 44, which will be described later, are placed. Further, upstream of the transfer device 42 and the image carrier 44, registration rollers 38 for positional alignment are placed. Further, eject rollers 40 are placed near the outlet 34 of the transport path 32.

Thus, a recording medium moved by the feed roller 24 from one of the paper cassettes 22 of the paper feeder units 18*a* to 18*d* is fed separately by the retard roller 26 and the feed roller 28, guided onto the transport path 32, and temporarily stopped by the registration rollers 38. By accurately-timed passage of the medium in contact with and between the transfer device 42 and the image carrier 44, which will be described later, a developer image is transferred onto the medium. After the developer image thus transferred to the medium is fixed by the fixing device 36, the medium is ejected by the eject rollers 40 from the outlet 34 to the output tray 16.

In the case of both side printing, however, the medium gets back to a reverse path. Specifically, there is a two-way divergence just before the eject rollers 40 on the transport path 32 and a switching pawl 46 is provided at the divergence. A reverse path 48 is formed for going back from the divergence to the registration rollers 38. Transport rollers 50*a* to 50*c* are provided along the reverse path 48. In the case of both side printing, the switching pawl 46 is placed to a position to open the reverse path 48 and the eject rollers 40 rotates reversely after catching the recording medium before the back end of the medium enters the eject rollers 40. Then, the recording medium is guided onto the reverse path 48 and returned to the registration rollers 38. The other side of the medium is let to pass in contact with and between the transfer device 42 and the image carrier 44 and pass through the fixing device 36, and the medium is ejected from the outlet 34 to the output tray 16.

The output tray 16 has a tilt plate 52 that is turnable with respect to the image forming apparatus main body. The tilt plate 52 is low under the outlet and tilting, gradually raised toward the front (toward the right in FIG. 1); that is, it has the low bottom end under the outlet and the high top end. The tilt plate 52 is supported on the image forming apparatus main body 12 such that it is turnable on its bottom end. As indicated by a two-dot chain line in FIG. 1, when the tilt plate 52 is turned upward to be open, an opening 54 is formed and a process cartridge 64 can be installed and removed through the opening 54.

The image forming section 14 is, for example, of an electrophotographic type, and composed of the image carrier 44 made of a photoreceptor, a charging member 56, for example, formed of a charging roller which charges the image carrier 44 evenly in press-contact with the latter, an optical projection device 58 which, by light irradiation, projects a latent image onto the image carrier 44 charged by the charging member 56, a development device 60 which applies a developer to a latent image formed on the image carrier 44 by the optical projection device 58, thus making the latent image visible, the transfer device 42, for example, formed of a transfer roller which transfers a developer image created by the development device 60 onto a paper sheet, a cleaning device 62, for example, formed of a blade which clears remaining developer particles from the image carrier 44, and the fixing device 36, for example, formed of a pressure roller and a heating roller which fuse and fixate the developer image on the paper sheet transferred by the transfer device 42 to the paper sheet. The optical projection device 58 is, for example, formed of a scan-type laser illumination device, placed in parallel with the above-mentioned paper feeder units 18*a* to 18*d* and nearer to the front of the image forming apparatus main body 12, and emits light that passes across the development device 60 and irradiates the image carrier 44. The light irradiation position on the image carrier 44 is a projected latent image position P. Although the scan-type laser illumination device is used as the optical projection device 58, an LED, a surface emitting laser, etc. may be used in other exemplary embodiments.

The process cartridge 64 is a cartridge in which the image carrier 44, the development device 60, and the cleaning device 62 are integrated. The process cartridge 64 is installed directly under the tilt plate 52 of the output tray 16 and installed and removed through the opening 54 formed when the tilt plate 52 is opened, as described above.

A controller 66 that controls the devices and units constituting the image forming apparatus 10 is also provided inside the image forming apparatus main body 12.

Figure 2:
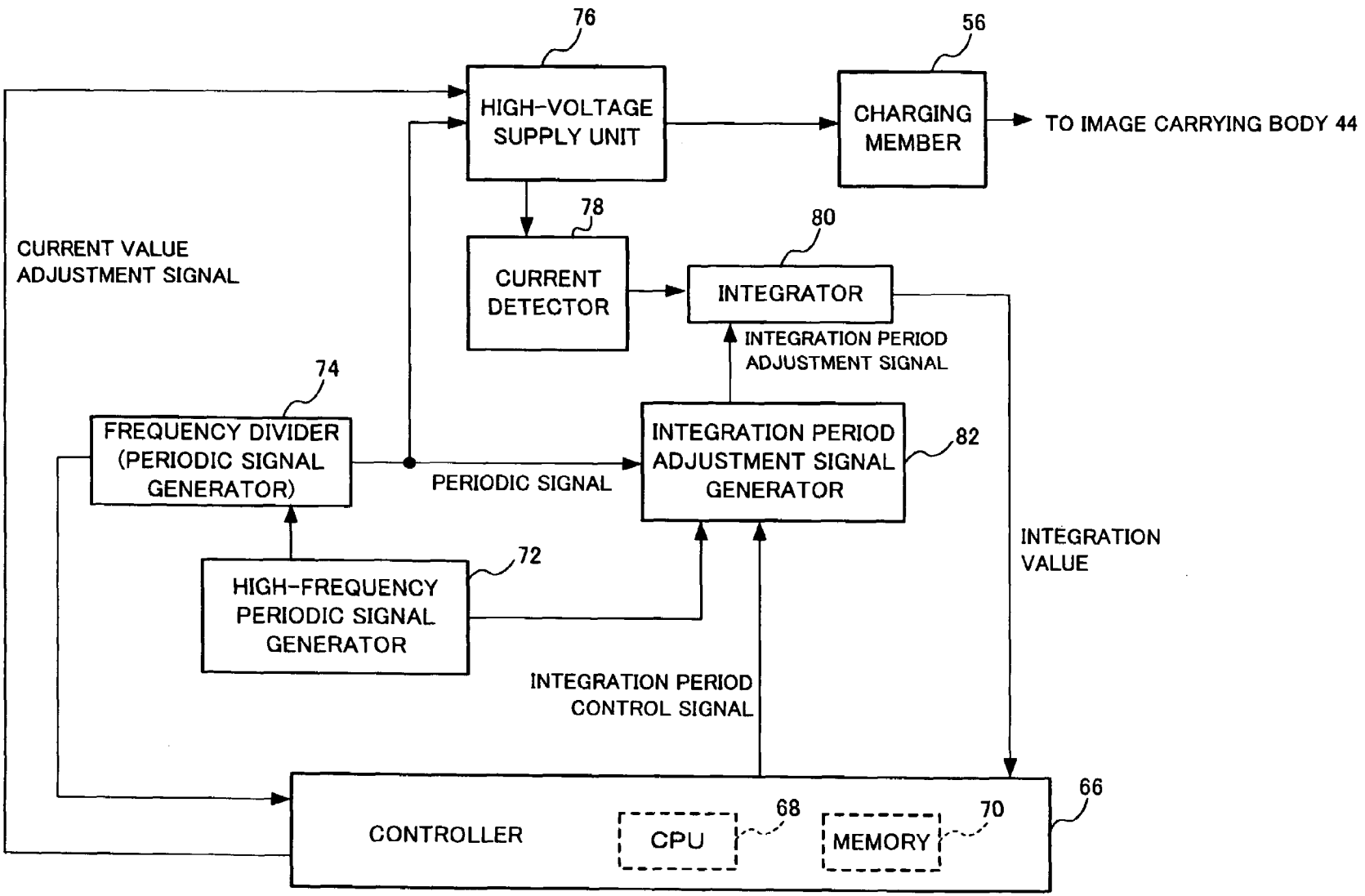
FIG. 2 is a block diagram showing details of a first example of an arrangement including a charging member, a controller, and its periphery.

FIG. 2 shows details of a first example of an arrangement including the charging member 56, the controller 66, and its periphery.

A high-frequency periodic signal generator 72 generates and outputs a periodic signal (clock) with a high frequency, e.g., 5 MHz (a cycle period of 0.2 μs) to a frequency divider 74 and an integration period adjustment signal generator 82. The high-frequency periodic signal output by the high-frequency periodic signal generator 72 is used to determine characteristic parameters such as a peak-to-peak voltage, duty, and frequency of an AC voltage that is applied to the charging roller 56. The frequency divider 74 divides the frequency of the high-frequency periodic signal input from the high-frequency periodic signal generator 72, for example, divides the frequency by 5,000, thus generating and outputting a periodic signal with 1 KHz (a cycle period of 1 ms) in sync with the high-frequency periodic signal to a high-voltage supply unit 76, the integration period adjustment signal generator 82, and the controller 66. Here, the frequency divider 74 serves as a periodic signal generator that generates a periodic signal (periodic signal for electrification) to be used by the high-voltage supply unit 76 to set the cycle period of a current for electrifying the charging roller 56.

The high-voltage supply unit 76 in which a cycle period is set by the periodic signal input from the frequency divider 74 and a current value is set by a current value adjustment signal input from the controller 66 generates a high voltage, e.g., 1,000 V or higher to electrify the charging member 56. The high-voltage supply unit 76 allows a current (electrifying current) in which an AC component having substantially the same cycle period as the periodic signal input from the frequency divider 74 is superimposed on a DC component to flow through the charging member 56. A current detector 78 detects the current allowed to flow through the charging member 56 by the high-voltage supply unit 76 and outputs the AC component of the detected current to an integrator 80.

The integrator 80 receives an integration period adjustment signal, which will be described later using FIG. 4 and others, from the integration period adjustment signal generator 82, integrates the AC component of the current (AC current Iac), e.g., illustrated in FIG. 3A, input from the current detector 78 for every integration period determined by the integration period adjustment signal, and outputs an integration value (a charge quantity) to the controller 66. If the AC current Iac exceeds a predetermined value, a discharge occurs in relation to the cycle period of the voltage generated by the high-voltage supply unit 76 and a discharge current indicated by a bold dotted line in FIG. 3A flows in addition to the AC current Iac. The discharged electricity is also added to the integration value output by the integrator 80, as indicated by a bold dotted line in FIG. 3B.

The controller 66 operates as a computer having a CPU 68 and a memory 70. The controller 66 compares the phase of multiple integration values input from the integrator 80 to the phase of a periodic signal input from the frequency divider 74 and generates and outputs an integration period control signal to control proper start and end time instances of integration by the integrator 80 with reference to the periodic signal to the integration period adjustment signal generator 82. Here, the controller 66 is adapted to generate integration period control signals respectively indicative of the start and end time instances of integration by the integrator 80, for example, by specifying a delay time with reference to the rising edge of the periodic signal input from the frequency divider 74 in units of high-frequency periodic signal pulses.

The controller 66 may be adapted to increment the delay with reference to the rising edge of the periodic signal input from the frequency divider 74 gradually from 0, receive multiple integration values from the integrator 80, and generate integration period control signals. The controller 66 may be adapted to hold proper start and end time instances of integration with reference to the periodic signal, obtained from results of an experiment conducted in advance.

The integration period adjustment signal generator 82 includes a counter (not shown) to count the pulses of the high-frequency periodic signal input from the high-frequency periodic signal generator 72. The integration period adjustment signal generator 82 receives the high-frequency periodic signal from the high-frequency periodic signal generator 72, periodic signal from the frequency divider 74, and integration period control signal from the controller 66, and generates and outputs an integration period adjustment signal, which will be described below, to the integrator 80, when a certain number of high-frequency periodic signal pulses has been counted.

Figure 4:
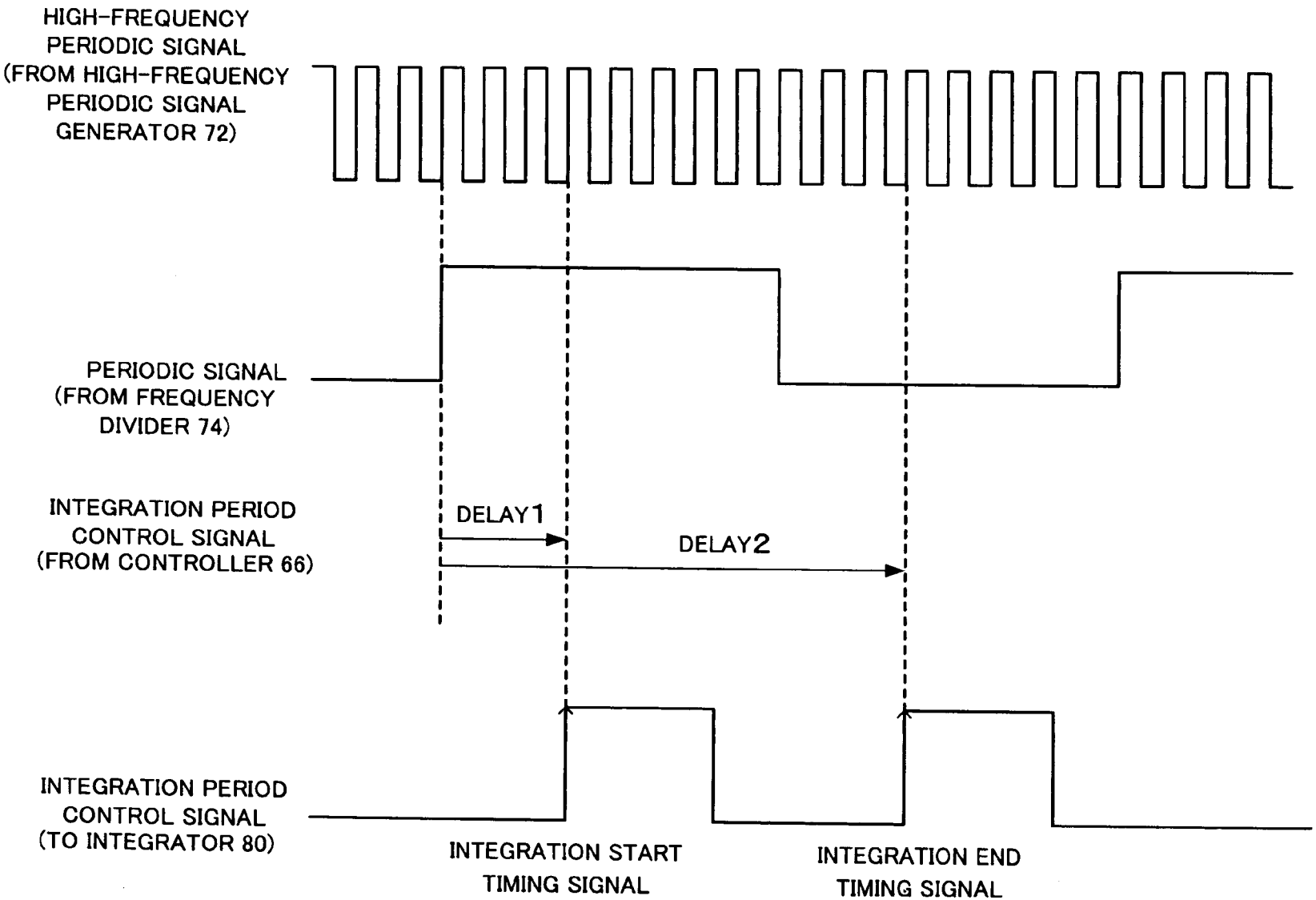
FIG. 4 is a timing chart schematically showing an integration period adjustment signal which is generated by an integration period adjustment signal generator.

FIG. 4 is a timing chart schematically showing an integration period adjustment signal which is generated by an integration period adjustment signal generator 82.

The integration period adjustment signal generator 82 starts to count the pulses of the high-frequency periodic signal input from the high-frequency periodic signal generator 72 in sync with the rising edge of the periodic signal input from the frequency divider 74. When the number of high-frequency periodic signal pulses counted has become equal to the number of high-frequency periodic signal pulses corresponding to a delay time (delay 1) until the integration start time instant indicated by an integration period control signal input from the controller 66, the integration period adjustment signal generator 82 outputs an integration start timing signal indicative of the timing at which the integrator 80 should start integration as the rising edge of an integration period adjustment signal pulse to the integrator 80.

For example, if the number of high-frequency periodic signal pulses corresponding to delay 1 is 1,000, a delay time unit the integration start time instant is 0.2 μs×1,000=200 μs. When the count of the high-frequency periodic signal pulses has reached 1,000, the integration period adjustment signal generator 82 outputs an integration start timing signal as the rising edge of an integration period adjustment signal.

When the number of high-frequency periodic signal pulses counted has become equal to the number of high-frequency periodic signal pulses corresponding to a delay time (delay 2) until the integration end time instant indicated by an integration period control signal input from the controller 66, the integration period adjustment signal generator 82 outputs an integration end timing signal indicative of the timing at which the integrator 80 should terminate integration as the rising edge of an integration period adjustment signal pulse to the integrator 80. Each signal edge is not limited to the rising edge and alternatively may be a falling edge.

In this way, a period of integration by the integrator 80 (integration start timing and end timing) is determined, based on the periodic signal having substantially the same cycle period as the AC current Iac.

Next, an operation in which the controller 66 changes the amount of AC current Iac is described.

The controller 66 is adapted to detect the phase of multiple AC current Iac integration values (charge quantities), determine an integration period for obtaining an accurate charge quantity, and determine a suitable amount of AC current Iac for charging the image carrier 44 by changing the amount of AC current Iac during the determined integration period.

Figure 5A:
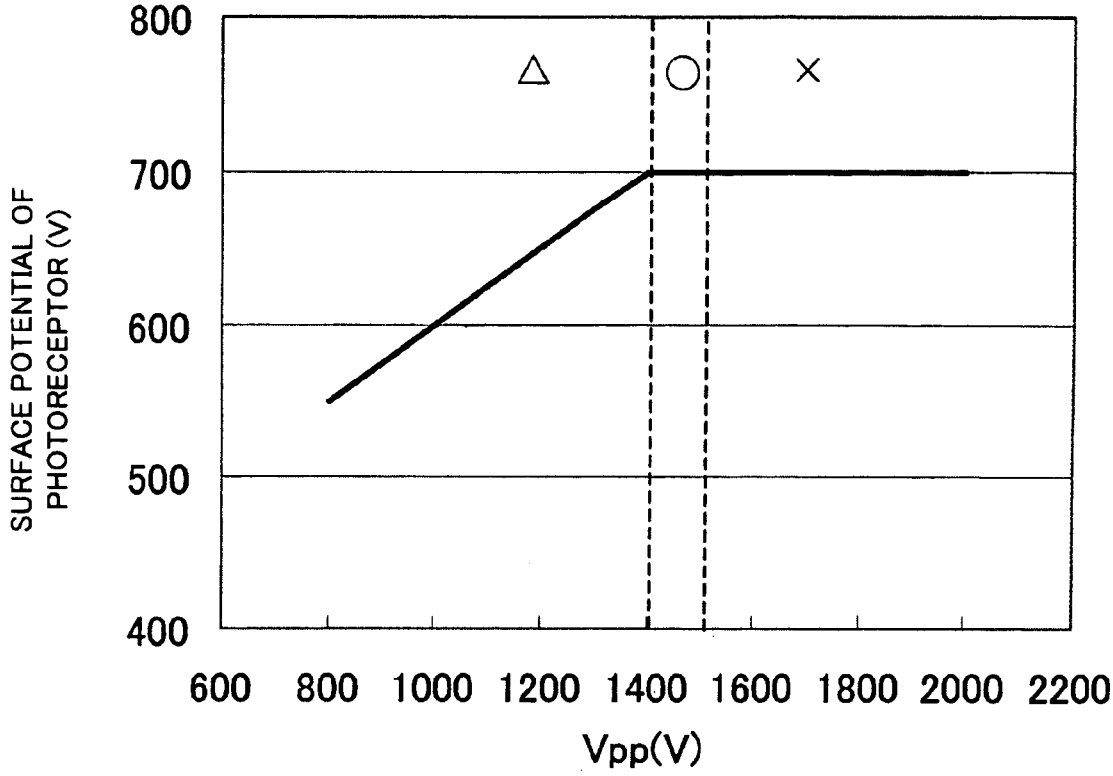
Figure 5B:
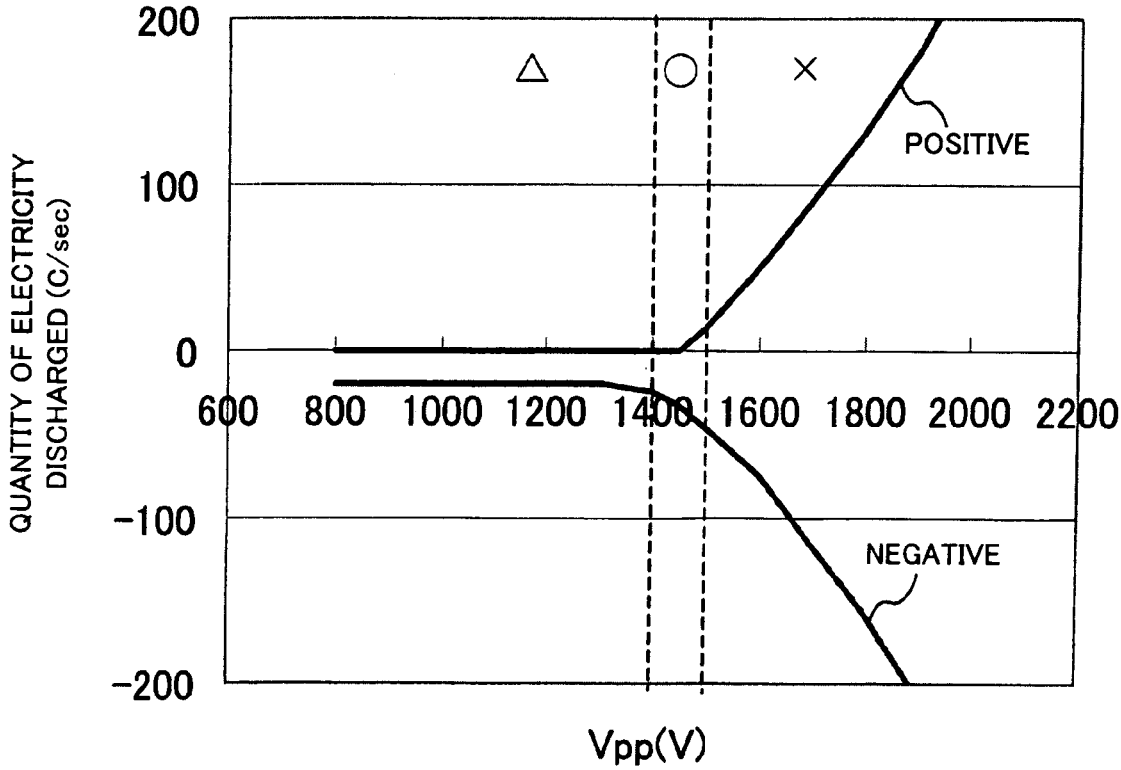

FIGS. 5A and 5B are graph representations of surface potential of the image carrier (photoreceptor) 44 and of the quantity of electricity discharged from the charging member 56 to the image carrier 44 when a peak-to-peak voltage Vpp (V) of AC voltage is changed to change the amount of AC current Iac. FIG. 5A is a graph showing change in the surface potential of the image carrier (photoreceptor) in relation to change in the peak-to-peak voltage Vpp. FIG. 5B is a graph showing change in the quantity of electricity discharged in relation to change in the peak-to-peak voltage Vpp.

As shown in FIG. 5A, when the peak-to-peak voltage Vpp of the AC voltage applied to the charging member 56 increases from about 800 V to about 1,400 V by control of the controller 66, the surface potential of the image carrier 44 increases generally proportionately. Meanwhile, when the peak-to-peak voltage Vpp of the AC voltage exceeds about 1,400 V, discharge occurs and the surface potential of the image carrier 44 is saturated, showing no change even with a further increase of the peak-to-peak voltage Vpp, and remains at a virtually constant value.

That is, about 1,400 V is an inflection point of change in the surface potential of the image carrier 44 in relation to change in the peak-to-peak voltage Vpp. In FIG. 5A, in a domain up to a peak-to-peak voltage Vpp of about 1,400 V, no discharge occurs and there is no damage such as wear to the image carrier 44. In the domain marked Δ, however, the quantity of charge for charging the image carrier 44 is insufficient. Due to this, image defects such as white points may occur in an image to be formed on paper and, therefore, the voltages in this domain cannot be used as the AC voltage for forming an image on paper. Nevertheless, in the domain marked Δ, no discharge occurs and the surface potential of the image carrier 44 is generally proportional to change in the peak-to-peak voltage Vpp. Thus, the voltages in this domain are used for control to determine a suitable amount of AC current Iac, which will be described later.

In FIG. 5A, voltages in a domain marked x where the peak-to-peak voltage Vpp is more than a given voltage above about 1,400 V cause wear and the like to the image carrier 44 and, therefore, cannot be used for forming an image on paper and for control, either.

Thus, peak-to-peak voltages Vpp from about 1,400 to 1,500 V in a domain marked O including about 1,400 V that is the inflection point plus a margin (tolerance) of a given voltage value (e.g., 100 V) are AC voltages corresponding to an amount of AC current Iac suitable for forming an image on paper.

Figures 3A, 3B:
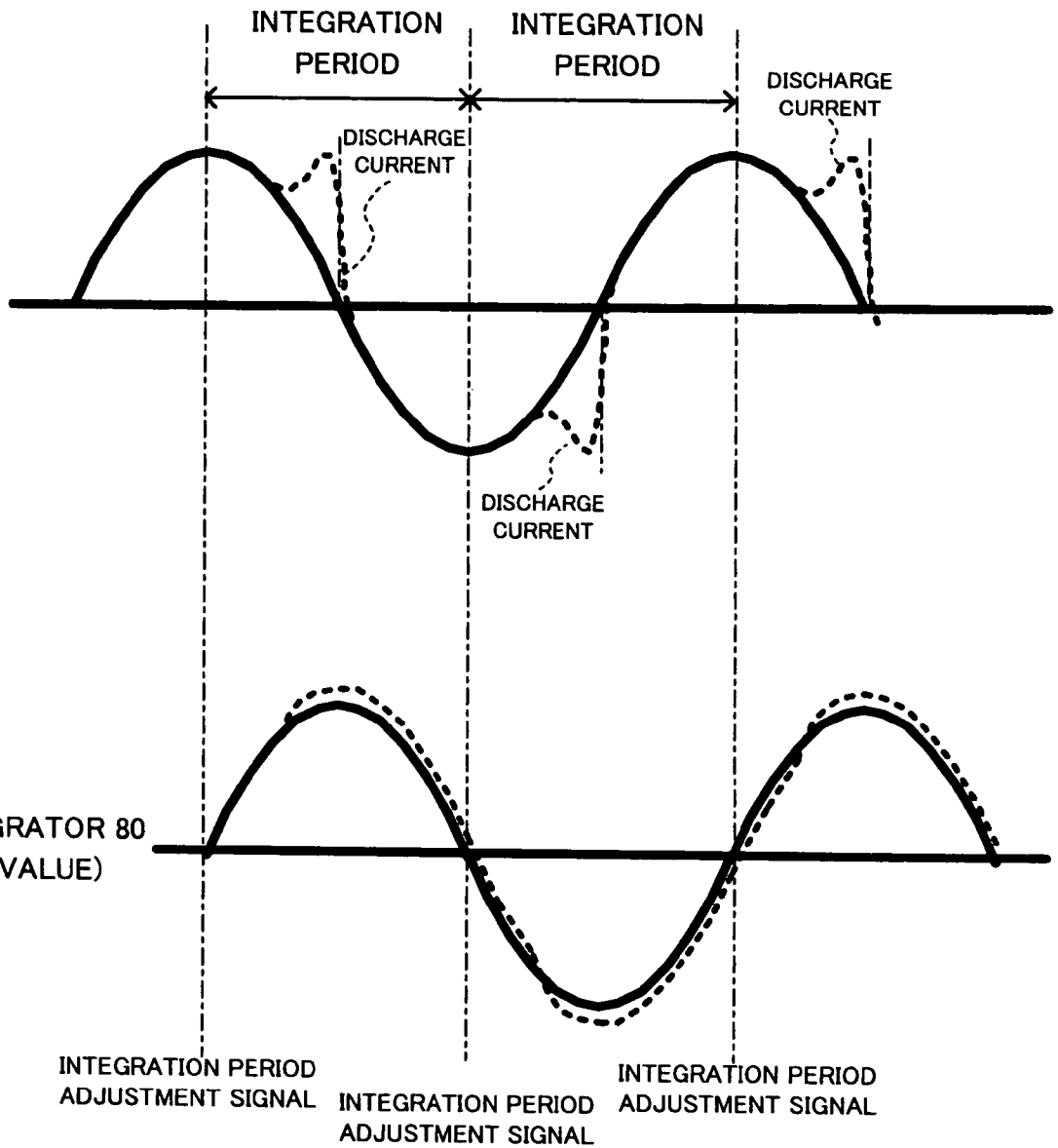
FIGS. 3A and 3B are graphs representing a relation between a period of integration of AC current Iac and an integration value output by an integrator.

As shown in FIG. 5B, in a domain where the peak-to-peak voltage Vpp that is applied to the charging member 56 by control of the controller 66 ranges from about 800V to about 1,400V, a discharge current as indicated in FIG. 3A does not flow and the quantities of positive and negative electricity discharged of the AC current Iac do not change even with an increase of the peak-to-peak voltage Vpp. In FIG. 5B, the quantity of negative electricity discharged includes electricity depending on the DC component.

Meanwhile, when the peak-to-peak voltage Vpp of the AC voltage exceeds about 1,400, discharge occurs and both the absolute values of the quantities of positive and negative electricity discharged of the AC current Iac increase, as the peak-to-peak voltage Vpp increases.

Hence, as is the case for FIG. 5A, peak-to-peak voltages Vpp from about 1400 to 1500 V in a domain marked O including about 1,400 V that is the inflection point plus a margin of a given voltage value (e.g., 100 V) are AC voltages corresponding to an amount of AC current Iac suitable for forming an image on paper.

Figure 6A:
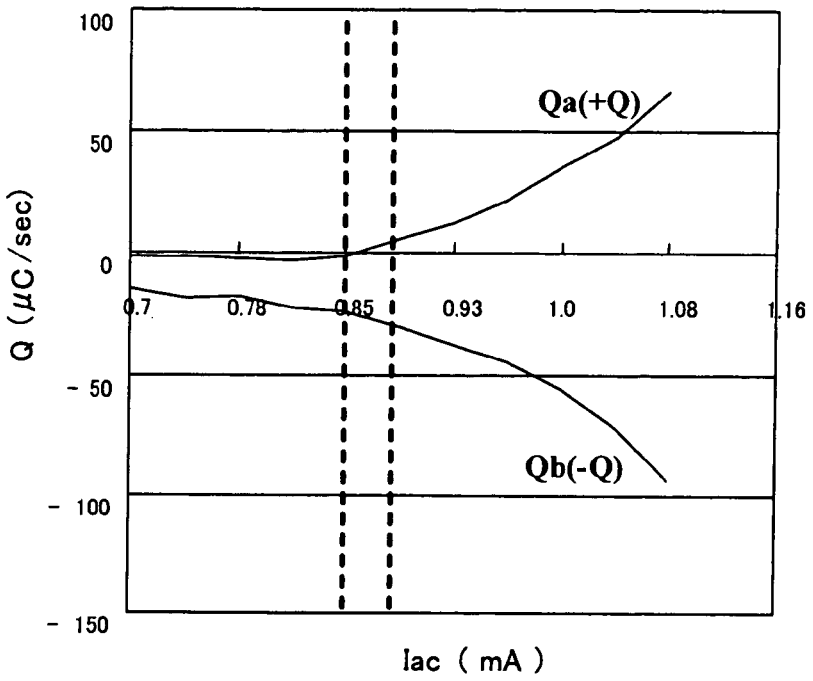
Figure 6B:
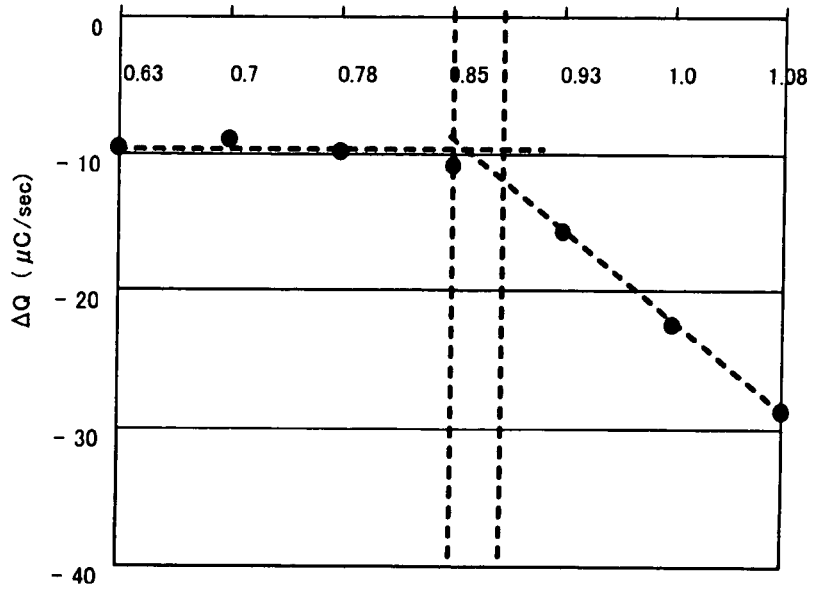

FIGS. 6A and 6B are graphic representations of quantities of electricity discharged from the charging member 56 to the image carrier 44 when the amount of AC current Iac is changed. FIG. 6A is a graph showing change in quantities of both positive and negative electricity discharged in relation to change in the AC current Iac and FIG. 6B is a graph showing change in differential charge in relation to change in the AC current Iac.

As shown in FIG. 6A, in a domain where the AC current Iac allowed to flow by control of the controller 66 is up to about 0.85 mA, a discharge current as indicated in FIG. 3A does not flow and neither of the quantities of positive or negative electricity discharged (Qa, Qb) added to the charge quantity of the AC current Iac changes much even with an increase in the AC current Iac. In FIG. 6A, the quantity of negative electricity discharged includes electricity depending on the DC component.

Meanwhile, when the AC current exceeds about 0.85 mA, discharge occurs and both the absolute values of the quantities of positive and negative electricity discharged increase, as the AC current Iac increases.

Here, assuming that differential charge $\Delta Q=|Qa|-|Qb|$, as shown in FIG. 6B, differential charge $\Delta Q$ does not change even with an increase of the AC current Iac until the AC current Iac reaches about 0.85 mA, but differential charge $\Delta Q$ changes with an increase of the AC current Iac after the AC current Iac exceeds about 0.85 mA. That is, about 0.85 mA is an inflection point of change in the quantity of electricity discharged in relation to change in the AC current Iac.

Hence, currents in a domain including 0.85 mA plus a margin of a given value correspond to an amount of AC current Iac suitable for forming an image on paper.

Figures 7A, 7B, 7C:
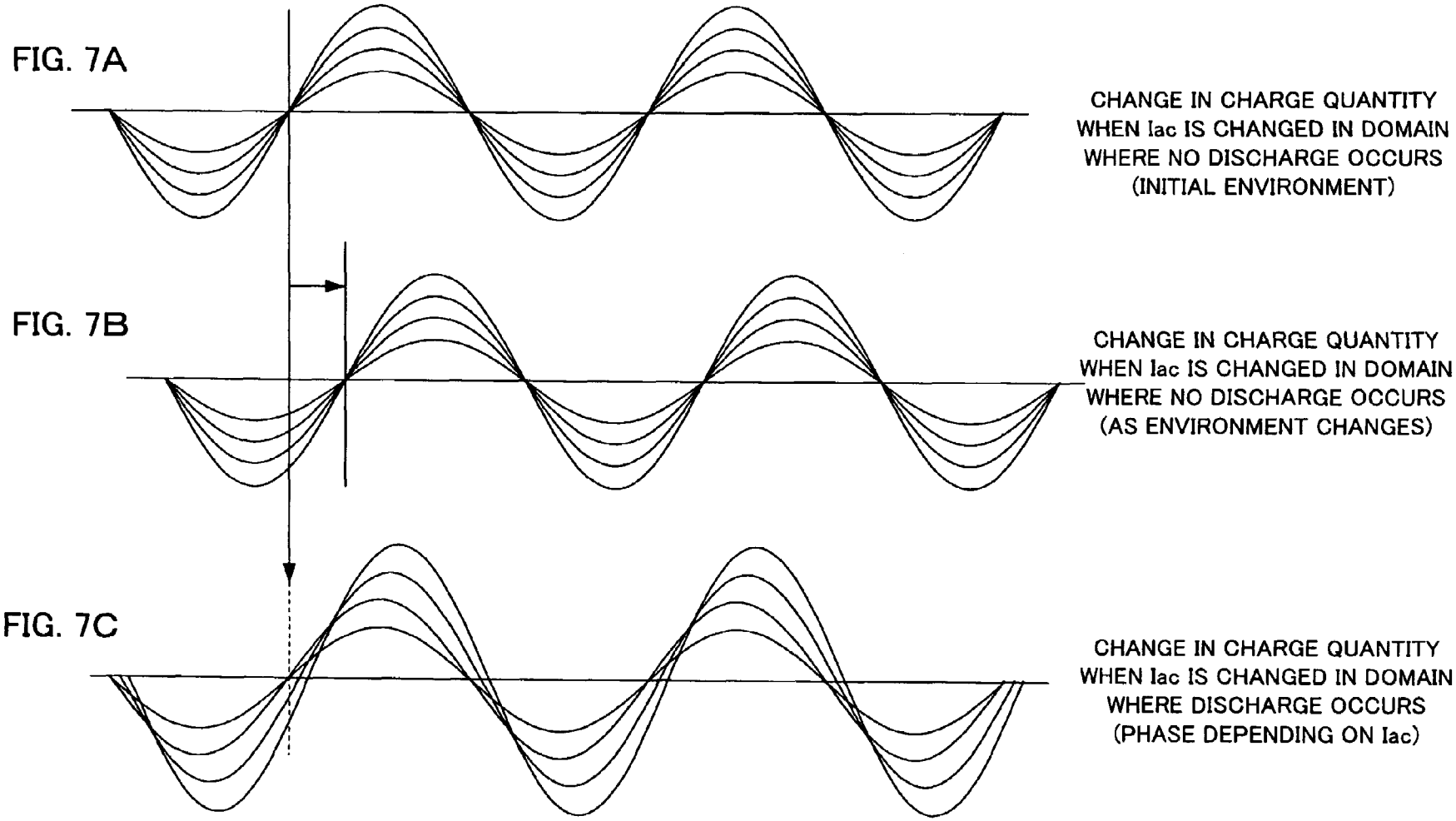

FIGS. 7A, 7B, and 7C are graphic representations of phases of charge quantities (integration values of AC current Iac) when the amount of AC current Iac is changed. FIG. 7A is a graph showing a phase in a domain where no discharge occurs in the initial environment (amount of AC current Iac), FIG. 7B is a graph showing a phase in a domain where no discharge occurs, as the environment changes, and FIG. 7C is a graph showing a phase in a domain where discharge occurs.

As shown in FIG. 7A, when the amount of AC current Iac is changed in the domain where no discharge occurs in the initial environment, the amount of charge quantity changes in relation to the amount of AC current Iac, but the phase of the charge quantity does not change.

Meanwhile, as shown in FIG. 7B, in the case where the environment has changed from the initial environment, when the amount of AC current Iac is changed in the domain where no discharge occurs, the amount of charge quantity changes in relation to the amount of AC current Iac and the phase of charge quantity changes according to the change in the environment. However, the phase of charge quantity remains unchanged even when the amount of Ac current Iac varies.

In comparison to the above two graphs, as shown in FIG. 7C, when the amount of AC current Iac is changed in the domain where discharge occurs, the amount of charge quantity changes in relation to the amount of AC current Iac and the phase of charge quantity also changes in relation to the amount of AC current Iac.

Thus, the controller 66 can determine a suitable amount of AC current Iac for charging the image carrier 44 by detecting a reference phase of charge quantity in the domain where no discharge occur, changing the amount of AC current Iac, and looking for an amount (inflection point) of AC current Iac at which the phase of charge quantity starts to change from the reference phase.

The controller 66 is adapted to determine the phase of charge quantity based on the rising edge of a periodic signal output by the frequency divider 74.

Figure 8:
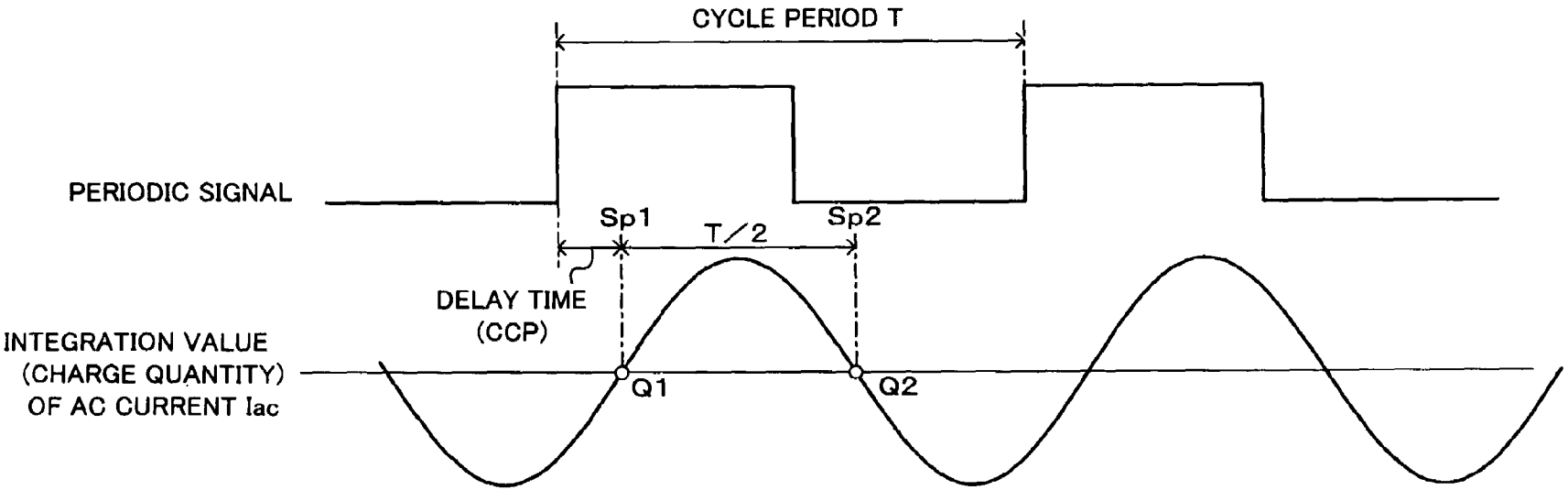
FIG. 8 is a timing chart showing an integration value (charge quantity) of AC current Iac being out of phase from a periodic signal.

FIG. 8 is a timing chart showing an integration value (charge quantity) of AC current Iac being out of phase from a periodic signal.

Given that T denotes the cycle period of a periodic signal, which is substantially the same as that of AC current Iac, an integration value (charge quantity) of AC current Iac changes in a cycle period T, delayed with reference to the periodic signal. When determining the phase of charge quantity, the amount of AC current Iac is first changed in the domain where no discharge occurs and the phase not depending on the amount of AC current Iac is determined in terms of a delay time with reference to the periodic signal.

For example, given that Q1 denotes a charge at a polarity change point of charge quantity (a point at which charge quantity not depending on DC becomes 0; a position on the time axis) delayed from the rising edge of a periodic signal, a time from the rising edge of the periodic signal until Q1=0 corresponds to a delay time (CCP) of the charge quantity with reference to the periodic signal and the phase of the charge quantity can be determined by this delay time. Given that Q2 denotes a charge at a point delayed by T/2 from the point of Q1=0, Q2 is also a polarity change point of charge quantity (a point at which charge quantity not depending on DC becomes 0).

Hence, by looking for an amount of AC current Iac when the charge quantity at the positions Q1 and Q2 on the time axis begins to change, while changing the amount of AC current Iac from the domain where no discharge occurs to the domain where discharge occurs, what amount of AC current Iac causes a discharge to begin in the positive side (positive value) and the negative side (negative value) can be determined. Given that differential charge $\Delta Q=|Qa|-|Qb|$, the amount of AC current Iac causing a discharge to begin can be found as an inflection point.

By detecting a change in the charge quantity at the positions Q1 and Q2 on the time axis in this way, the amount of AC current Iac causing a discharge to begin can be found as an inflection point. In the following, in a condition that no discharge current flows, the position of Q1=0 on the time axis is referred to as a sampling point 1 (SP1) and the position of Q2=0 on the time axis is referred to as a sampling point 2 (SP2).

Figures 9A, 9B:
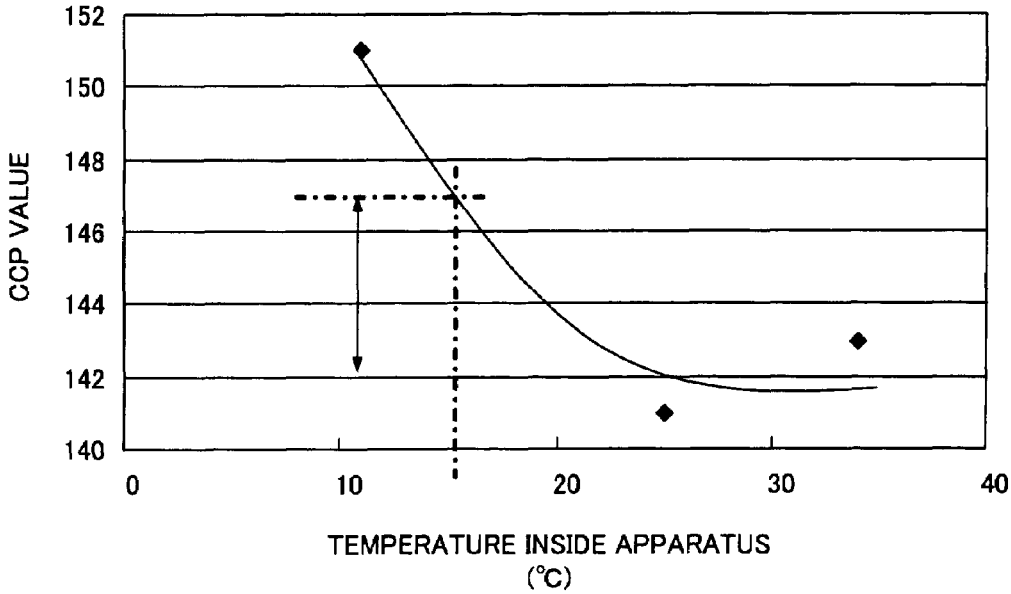

FIGS. 9A and 9B illustrate relationship between delay time (CCP) values of charge quantity with reference to a periodic signal and environmental conditions. FIG. 9A is a graph showing change in delay time in relation to temperature inside the image forming apparatus 10 (temperature inside apparatus) and FIG. 9B is a table associating environment details shown in FIG. 9A with delay time values.

As described above, the phase of charge quantity changes in relation to environmental change. Here, in the case of environmental change in which the delay time (CCP) value has increased or decreased by 5 or more, as indicated by an arrow in FIG. 9A, the accuracy of detecting charge quantity decreases and the accuracy of determining a suitable amount of AC current Iac decreases, if the sampling points SP1, SP2 are not changed responsive to the environmental change. This is found to affect the quality of an image that is formed by the image forming apparatus 10.

Next, a second example of an arrangement including the charging member 56, the controller 66, and its periphery is discussed.

Figure 10:
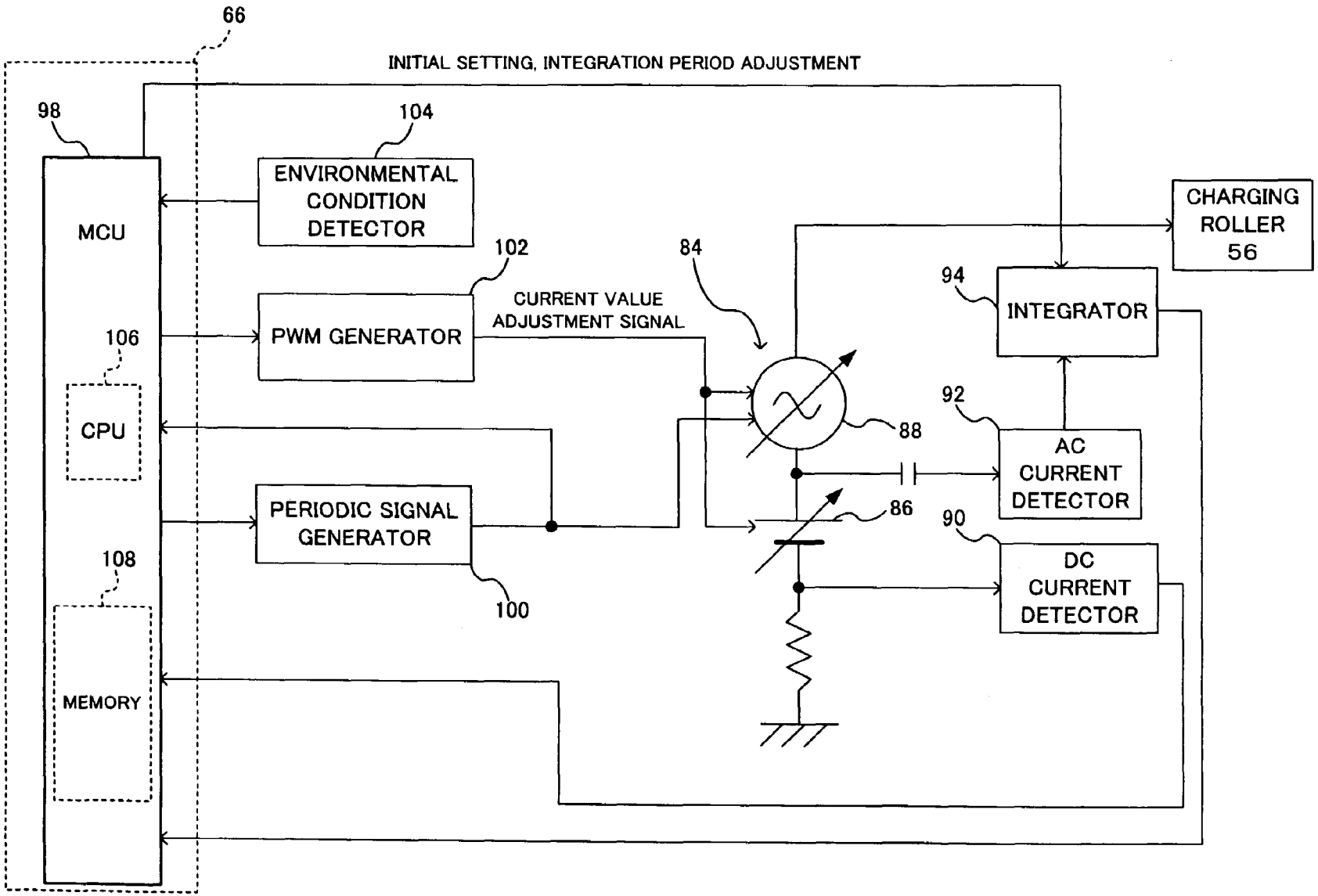
FIG. 10 is a block diagram showing a second example of an arrangement including a charging member, a controller, and its periphery.

FIG. 10 shows the second example of the arrangement including the charging member 56, the controller 66, and its periphery. A high-voltage supply unit 84 includes a variable DC power supply 86 and a variable AC power supply 88.

The variable DC power supply 86 generates an amount of DC voltage in accordance with a control signal (current value adjustment signal) which is input from a PWM generator 102 which will be described later. The variable AC power supply 88 generates an AC voltage to produce an AC current having substantially the same cycle period as a periodic signal which is input from a periodic signal generator 100 which will be described later. The amount (amplitude) of the AC current varies according to the control signal (current value adjustment signal) which is input from the PWM generator 102. The AC voltage generated by the variable AC power supply 88 is superimposed on the DC voltage generated by the variable DC power supply 86, so that a given charging current in which an AC computer is superimposed on a DC component is supplied to the charging member 56.

A DC current detector 90 detects a DC current which is supplied to the charging member 56 by a DC voltage generated by the variable DC power supply 86 and outputs the detected DC current to an MCU 98 which will be described later. An AC current detector 92 detects an AC current which is supplied to the charging member 56 by an AC voltage generated by the variable AC power supply 88 and outputs the detected AC current to an integrator 94. The integrator 94 integrates the AC current input from the AC current detector 92 and outputs a result as a charge quantity to the MCU 98.

The MCU (Micro Controller Unit) 98 includes a CPU 106, a memory 108, and multiple A/D converters which are not shown and constitutes a part of the controller 66. For example, the memory 108 stores a first association table (see FIG. 9) associating initial values of delay time (CCP values, the numbers of high-frequency periodic signal pulses, etc.) of charge quantity with reference to a periodic signal input from the periodic signal generator 100 which will be described later with environmental conditions and a second association table associating a margin to a degree that prevents the development of wear to the image carrier 44 with the amount of AC current Iac causing a discharge to begin (inflection point) for each environmental condition.

The first and second association tables include standard values judged appropriate for each environmental condition, based on results evaluated in advance by an experiment or the like.

The MCU 98 is adapted to set an initial value of delay time with reference to a periodic signal for the integrator 94, according to the information stored in the memory 108, and adjust the period of integration performed by the integrator 94 so that the variable AC power supply 88 supplies a proper AC current Iac to the charging member 56, according to detection results by an environment condition detector 104 which will be described later.

According to control of the MCU 98, the periodic signal generator 100 generates and outputs a periodic signal having substantially the same cycle period as the AC current produced by the variable AC power supply 88 to the variable AC power supply 88 and the MCU. The PWM generator 102 generates a pulse with a width determined under control of the MCU 98 and controls the amount of AC voltage generated by the variable AC power supply 88 and the amount of DC voltage generated by the variable DC power supply 86. The environmental condition detector 104 detects and outputs, for example, the temperature and humidity inside the image forming apparatus 10 to the MCU 98.

Figure 11:
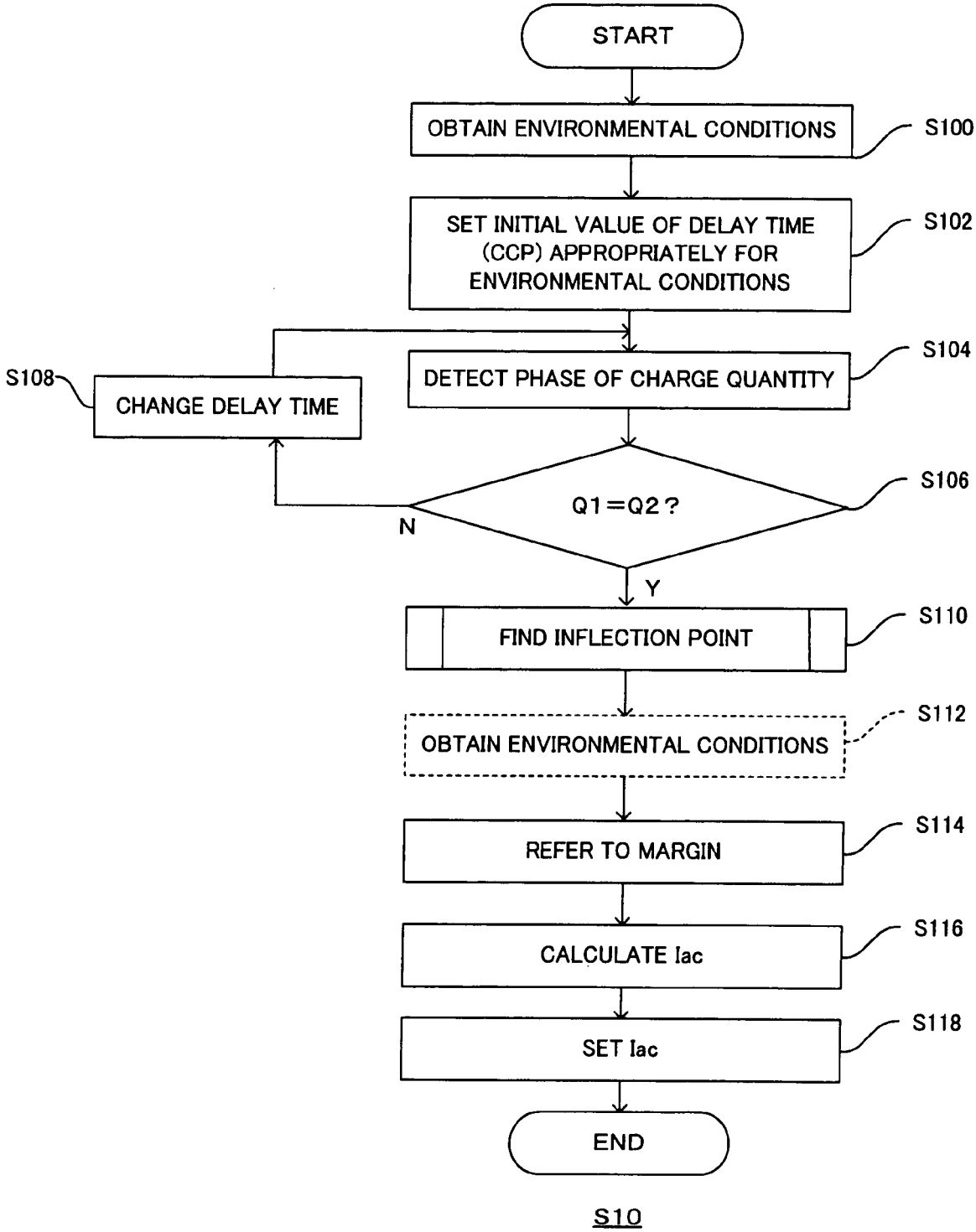
FIG. 11 is a flowchart illustrating a process (S10) for charging the image carrier with a proper charging current, which is performed, according to a program executed by the MCU mentioned in FIG. 10.

FIG. 11 is a flowchart illustrating a process (S10) for charging the image carrier 44 with a proper charging current, which is performed, according to a program executed by the MCU 98 mentioned in FIG. 10.

As shown in FIG. 11, at step 100 (S100), the MCU 98 obtains the temperature and humidity (environmental conditions) inside the image forming apparatus 10, detected by the environmental condition detector 104, when the apparatus is powered on.

At step 102 (S102), the MCU 98 reads the first association table (see FIG. 9B) stored in the memory 108 and sets an initial value of delay time (CCP) of charge quantity with reference to a periodic signal generated by the periodic signal generator 100 appropriately for the environmental conditions detected by the environmental condition detector 104. Here, the initial value set by the MCU 98 may be stored into the memory 108.

At step 104 (S104), the MCU 98 detects the phase of charge quantity by controlling the power supply so that the high-voltage supply unit 84 supplies an AC current Iac in a domain where no discharge occurs to the charging member 56 and detecting charge quantities which are input from the integrator 94 at the sampling points SP1, SP2 determined by the set delay time.

Figure 12:
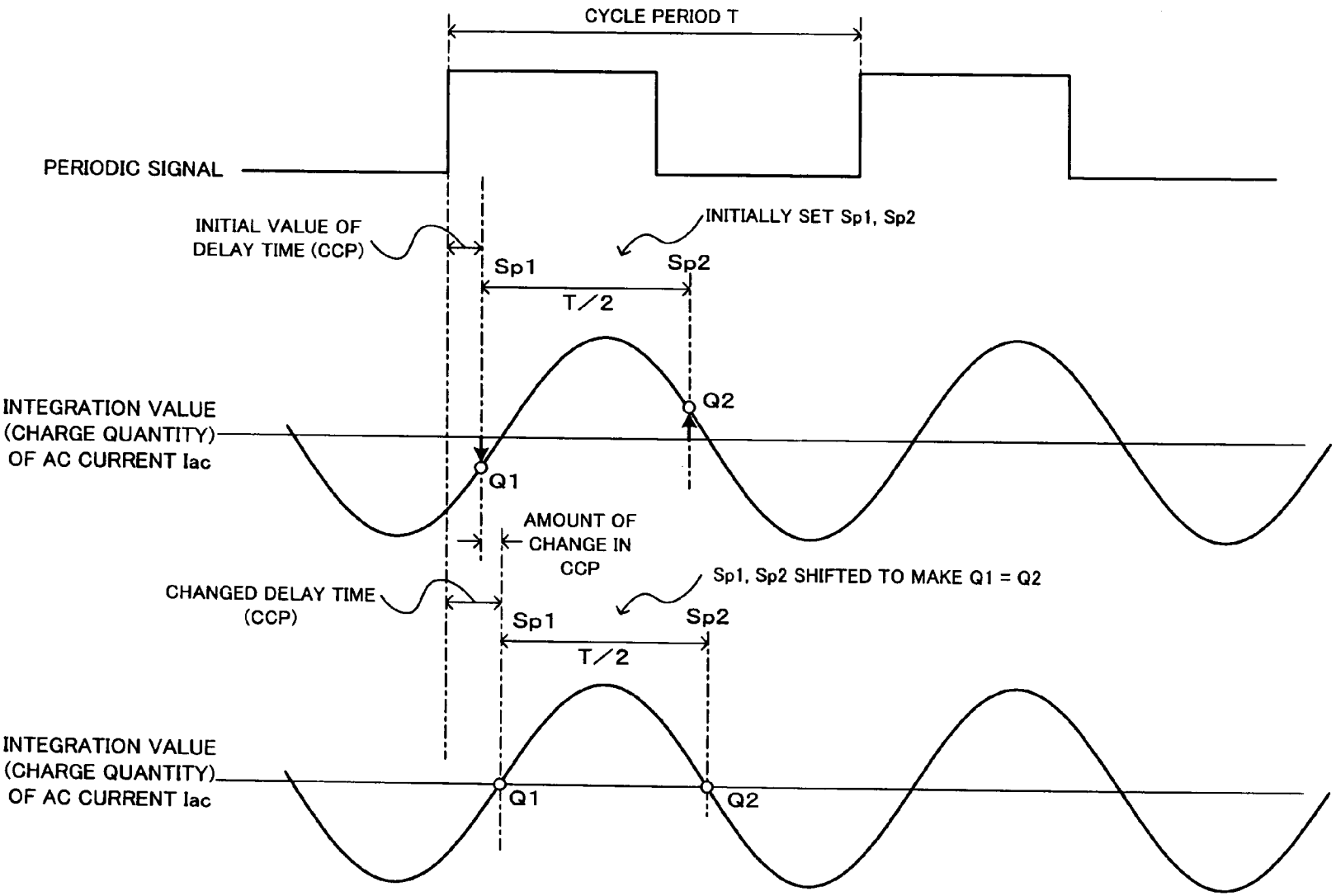
FIG. 12 is a timing chart to illustrate a process of detecting an integration value (charge quantity) of AC current Iac being out of phase from a periodic signal.

For example, the MCU detects charge quantities (Q1, Q2) input from the integrator 94 at the initially set sampling points S1, S2 determined by the set initial value of delay time (CCP), as illustrated in FIG. 12.

At step 106 (S106), the MCU 98 determines whether there is a match between Q1 and Q2 at the sampling points SP1, SP2. If there is a match, the process proceeds to step S110; if not, the process proceeds to step S108.

For example, as illustrated in FIG. 12, in the case where Q1 and Q2 at the initially set sampling points SP1, SP2 are different values, the process proceeds to step S108.

After adjustment such as changing the delay time, when a match occurs between Q1 and Q2 at the sampling points SP1, SP2, the phase of charge quantity is determined and the positions of the sampling points SP1, SP2 are fixed as the points at which charge quantities are sampled to look for an amount of AC current Iac causing a discharge to begin (see FIG. 12).

At step 108 (S108), the MCU 98 changes the initial or previous delay time and resets a delay time with reference to the periodic signal. That is, the MCU 98 resets a delay time corresponding to shifted sampling points SP1 and SP2 to make Q1=Q2.

At step 110 (S110), the MCU 98 looks for an amount of AC current Iac causing a discharge to begin as an inflection point (infection point finding) by gradually increasing the amount of AC current Iac from the domain where no discharge occurs to the domain where discharge occurs and calculating differential charge ΔQ serially (see FIG. 6).

At step 112 (S112), the MCU 98 obtains the temperature and humidity (environmental conditions) inside the image forming apparatus 10. The step S112 may not be performed; instead, the result of the step S100 is used.

At step 114 (S114), the MCU 98 reads the second association table stored in the memory 108 and refers to a margin of AC current Iac associated with the obtained environmental conditions.

At step 116 (S116), the MCU 98 calculates a proper value (or range) of AC current Iac by adding the margin referred to in step S114 to the amount of AC current Iac found in step S110.

At step 118 (S118), the MCU 98 sets the AC current Iac calculated in step S116.

Next, a third example of an arrangement including the charging member 56, the controller 66, and its periphery is discussed.

Figure 13:
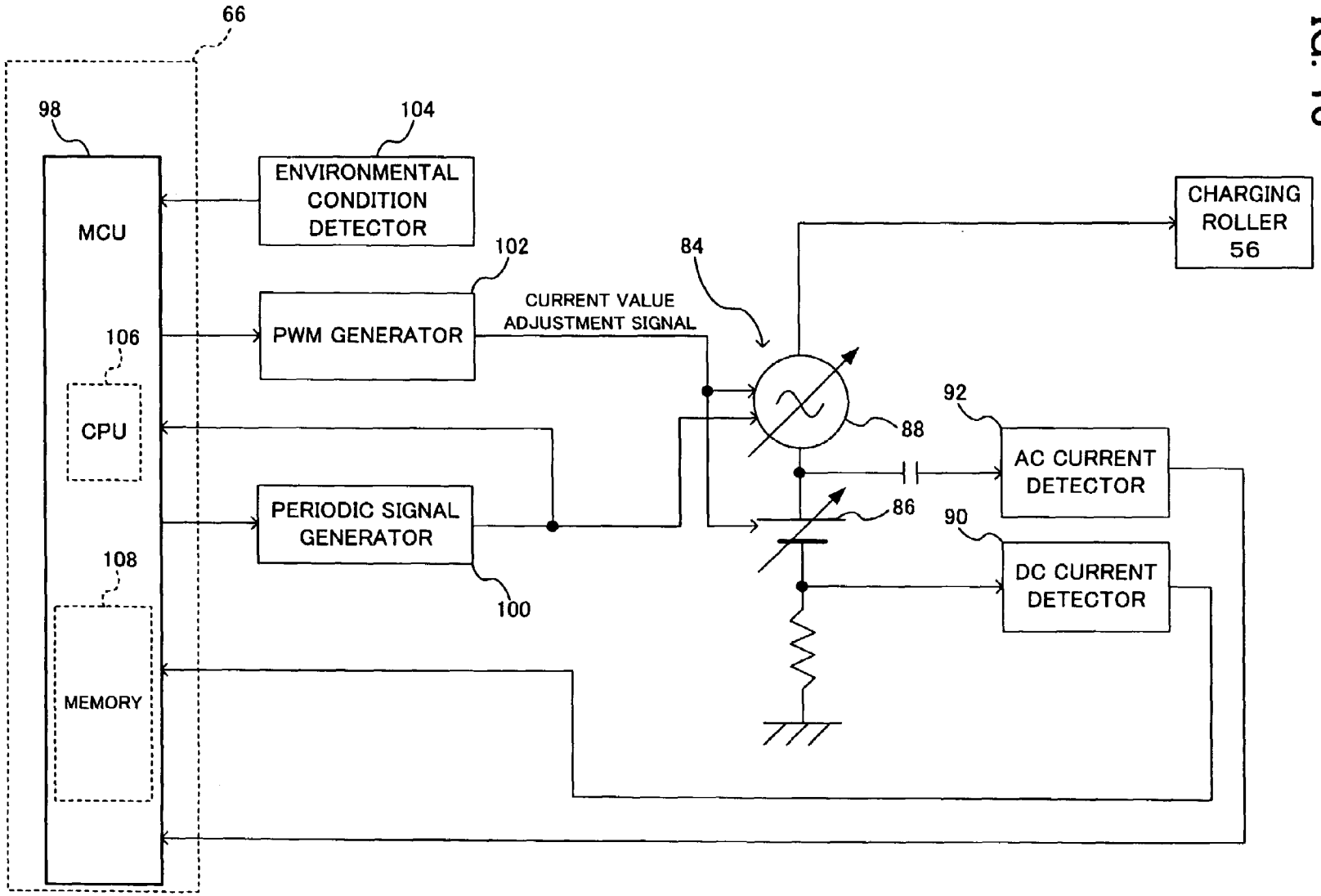
FIG. 13 is a block diagram showing a third example of an arrangement including a charging member, a controller, and its periphery.

FIG. 13 shows the third example of the arrangement including the charging member 56, the controller 66, and its periphery. In the third example shown in FIG. 13, components that are substantially the same as those of the second example shown in FIG. 10 are assigned the same reference numbers.

In the third example, the MCU 98 is adapted to perform A/D conversion of an AC current that is input from the AC current detector 92 by an A/D converter which is not shown and perform AC current integration processing.

Figure 14:
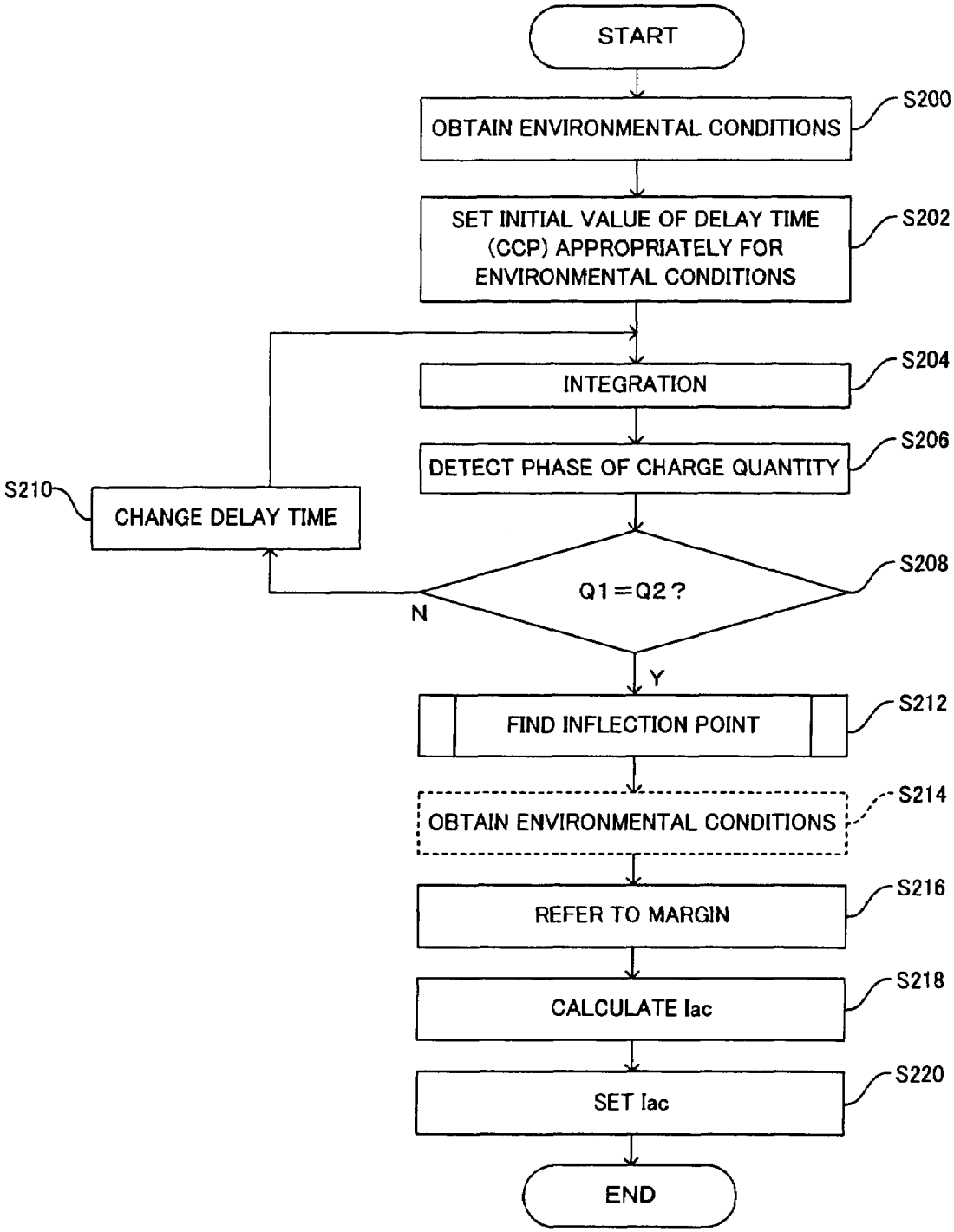
FIG. 14 is a flowchart illustrating a process (S20) for charging the image carrier with a proper charging current, which is performed, according to a program executed by the MCU mentioned in FIG. 13.

FIG. 14 is a flowchart illustrating a process (S20) for charging the image carrier 44 with a proper charging current, which is performed, according to a program executed by the MCU 98 mentioned in FIG. 13.

As shown in FIG. 14, at step 200 (S200), the MCU 98 obtains the temperature and humidity (environmental conditions) inside the image forming apparatus 10, detected by the environmental condition detector 104, when the apparatus is powered on.

At step 202 (S202), the MCU 98 reads the first association table (see FIG. 9B) stored in the memory 108 and sets an initial value of delay time (CCP) of charge quantity with reference to a periodic signal generated by the periodic signal generator 100 appropriately for the environmental conditions detected by the environmental condition detector 104. Here, the initial value set by the MCU 98 may be stored into the memory 108.

At step 204 (S204), the MCU 98 integrates an AC current that is input from the AC current detector 92.

At step 206 (S206), the MCU 98 detects the phase of charge quantity by controlling the power supply so that the high-voltage supply unit 84 supplies an AC current Iac in a domain where no discharge occurs to the charging member 56 and detecting charge quantities which are input from the integrator 94 at the sampling points SP1, SP2 determined by the set delay time.

At step 208 (S208), the MCU 98 determines whether there is a match between Q1 and Q2 at the sampling points SP1, SP2 (see FIG. 8). If there is a match, the process proceeds to step S212; if not, the process proceeds to step S210.

When there is a match between Q1 and Q2, the phase of charge quantity is determined and the positions of the sampling points SP1, SP2 are fixed as the points at which charge quantities are sampled to look for an amount of AC current Iac causing a discharge to begin.

At step 210 (S210), the MCU 98 changes the initial or previous delay time and resets a delay time with reference to the periodic signal.

At step 212 (S212), the MCU 98 looks for an amount of AC current Iac causing a discharge to begin as an inflection point (infection point finding) by gradually increasing the amount of AC current Iac from the domain where no discharge occurs to the domain where discharge occurs and calculating differential charge ΔQ serially (see FIGS. 6A and 6B).

At step 214 (S214), the MCU 98 obtains the temperature and humidity (environmental conditions) inside the image forming apparatus 10. The step S214 may not be performed; instead, the result of the step S200 is used.

At step 216 (S216), the MCU 98 reads the second association table stored in the memory 108 and refers to a margin of AC current Iac associated with the obtained environmental conditions.

At step 218 (S218), the MCU 98 calculates a proper value (or range) of AC current Iac by adding the margin referred to in step S216 to the amount of AC current Iac found in step S212.

At step 220 (S220), the MCU 98 sets the AC current Iac calculated in step S218.

In the above-described exemplary embodiments, the image forming apparatus 10 including one charging member 56 for charging one image carrier 44 is illustrated; however, the invention is not so limited. For example, in a color image forming apparatus including four image carrying bodies, the invention may be implemented to control the amount of each individual AC current Iac supplied to four charging devices that respectively charge the image carrying bodies.

The control procedure (by a program) that is performed by the controller 66 may be provided by means of communication or provided, stored in a storage medium such as CD-ROM.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that charges a body to be charged;

a detector that detects an AC component of a current flowing through the charging member;

an integration section that integrates the AC component of the current detected by the detector;

a controller that controls the current flowing through the charging member, according to a result of integration executed by the integration section;

a periodic signal generating section that generates a periodic signal having a cycle period corresponding to a cycle period of the AC component; and an integration period adjusting section that adjusts a period of integration executed by the integration section, with reference to the periodic signal.

2. The charging device according to claim 1, wherein the integration period adjusting section adjusts at least one of a start time and an end time of the integration period.

3. The charging device according to claim 2, wherein the integration period adjusting section adjusts the integration period by setting a delay time with reference to the periodic signal generated by the periodic signal generating section in accordance with a high-frequency periodic signal having a higher frequency than the periodic signal.

4. The charging device according to claim 3, wherein the high-frequency periodic signal is used to determine characteristic parameters of the AC component that is applied to the charging member.

5. A charging device comprising:

a charging member that charges a body to be charged;

a detector that detects an AC component of a current flowing through the charging member;

an integration section that integrates both positive and negative values of the AC component detected by the detector;

a controller that controls an amount of the AC component of the current supplied to the charging member, depending on a difference between positive and negative absolute values integrated by the integration section;

a periodic signal generating section that generates a periodic signal having a cycle period corresponding to a cycle period of the AC component; and an integration period adjusting section that adjusts at least one of a start time and an end time of the integration period of the integration section, by setting a delay time with reference to the periodic signal generated by the periodic signal generation section in accordance with a high-frequency periodic signal having a higher frequency than the periodic signal, and the high-frequency periodic signal being used to determine characteristic parameters of the AC component that is applied to the charging member.

6. An image forming apparatus comprising:

an image carrier;

a charging member that charges the image carrier;

a power supply section that supplies a current including an AC component to the charging member;

a detector that detects the AC component of the current supplied to the charging member by the power supply section;

an integration section that integrates the AC component of the current detected by the detector;

a controller that controls a current flowing through the charging member, according to a result of integration executed by the integration section;

a periodic signal generating section that generates a periodic signal having a cycle period corresponding to a cycle period of the AC component;

an integration period adjusting section that adjusts a period of integration executed by the integration section, with reference to the periodic signal;

an optical device that writes a latent image onto the image carrier charged by the charging member;

a development device that applies a developer to the latent image on the image carrier, thus forming a developer image;

a transfer device that transfers the developer image onto a recording medium; and a fixing device that fixes the developer image transferred by the transfer device to the recording medium.

7. The image forming apparatus according to claim 6, wherein the integration period adjusting section adjusts at least one of a start time and an end time of the integration period.

8. The image forming apparatus according to claim 7, wherein the integration period adjusting section adjusts the integration period by setting a delay time with reference to a periodic signal generated by the periodic signal generating section in accordance with a high-frequency periodic signal having a higher frequency than the periodic signal.

9. The image forming apparatus according to claim 8, wherein the high-frequency periodic signal is used to determine characteristic parameters of an AC component that is applied to the charging member.

10. The image forming apparatus according to claim 9, wherein the integration section integrates both positive and negative values of the AC component detected by the detector, and the controller controls an amount of the AC component of a current that is supplied to the charging member, depending on a difference between positive and negative absolute values integrated.

11. The image forming apparatus according to claim 8, further comprising:

an environmental condition detector that detects environmental conditions; and a setting section that sets an initial value of a delay time which is set by the integration period adjusting section, corresponding to the environmental conditions detected by the environmental condition detector.

12. The image forming apparatus according to claim 9, further comprising:

an environmental condition detector that detects environmental conditions; and a setting section that sets an initial value of a delay time which is set by the integration period adjusting section, corresponding to the environmental conditions detected by the environmental condition detector.

13. The image forming apparatus according to claim 10, further comprising:

an environmental condition detector that detects environmental conditions; and a setting section that sets an initial value of a delay time which is set by the integration period adjusting section, corresponding to the environmental conditions detected by the environmental condition detector.

14. A computer readable medium storing a charging control program causing a computer to perform a process comprising:

adjusting at least one of a start time and an end time of an integration period for integrating an AC component of a current flowing through a charging member that charges a body to be charged, with reference to a periodic signal having a cycle period corresponding to a cycle period of the AC component of a current flowing through the charging member; and adjusting an amount of the AC component of the current flowing through the charging member, based on a result of integration at least one of whose start time and end time has been adjusted.

15. The computer readable medium according to claim 14, the process further comprising:

integrating an AC component of a current flowing through a charging member that charges a body to be charged, wherein, depending on a result of the integration, at least one of the start time and the end time of the integration period for integrating the AC component of the current flowing through the charging member is adjusted, with reference to the periodic signal having the cycle period corresponding to the cycle period of the AC component of the current flowing through the charging member.

16. The computer readable medium according to claim 14, the process further comprising:

obtaining environmental conditions; and setting an initial value corresponding to the environmental conditions obtained, wherein the AC component of the current flowing through the charging member is integrated based on the set initial value.

17. A method for charging control, the method comprising:

adjusting at least one of a start time and an end time of an integration period for integrating an AC component of a current flowing through a charging member that charges a body to be charged, with reference to a periodic signal having a cycle period corresponding to a cycle period of the AC component of a current flowing through the charging member; and adjusting an amount of the AC component of a current flowing through the charging member, based on a result of integration whose start time instant or end time instant has been adjusted.

18. The method for charging control according to claim 17, further comprising:

integrating an AC component of a current flowing through a charging member that charges a body to be charged, wherein, depending on a result of the integration, at least one of the start time and the end time of the integration period for integrating the AC component of the current flowing through the charging member is adjusted, with reference to the periodic signal having the cycle period corresponding to the cycle period of the AC component of the current flowing through the charging member.

19. The method for charging control according to claim 17, further comprising:

obtaining environmental conditions;

obtaining environmental conditions; and setting an initial value corresponding to the environmental conditions obtained, wherein the AC component of the current flowing through the charging member is integrated based on the set initial value.

* * * * *